US007443315B2

(12) United States Patent
Lo

(10) Patent No.: US 7,443,315 B2
(45) **Date of Patent: *Oct. 28, 2008**

(54) LED TRAFFIC LIGHT

(76) Inventor: Teddy Yeung Man Lo, 19 Kent Road, Kowloon Tong, Hong Kong (CN)

( * ) Notice: Subject to any disclaimer, the term of this patent is extended or adjusted under 35 U.S.C. 154(b) by 77 days.

This patent is subject to a terminal disclaimer.

(21) Appl. No.: 10/506,058

(22) PCT Filed: Feb. 27, 2004

(86) PCT No.: PCT/US2004/006271

§ 371 (c)(1),
(2), (4) Date: Mar. 9, 2006

(87) PCT Pub. No.: WO2005/093684

PCT Pub. Date: Oct. 6, 2005

(65) Prior Publication Data

US 2006/0202861 A1 Sep. 14, 2006

(51) Int. Cl.
*G08G 1/095* (2006.01)

(52) U.S. Cl. ..... 340/907; 340/929; 340/930; 362/800; 362/231

(58) Field of Classification Search ..... 340/929, 340/930, 907, 909, 924, 925; 362/800, 231
See application file for complete search history.

(56) References Cited

U.S. PATENT DOCUMENTS

| | | | | |
|---|---|---|---|---|
| 3,593,445 | A * | 7/1971 | Gant | 40/617 |
| 3,618,005 | A | 11/1971 | Jensen | |
| 5,014,052 | A | 5/1991 | Obeck | |
| 5,150,116 | A | 9/1992 | West | |
| 5,898,381 | A * | 4/1999 | Gartner et al. | 340/815.65 |
| 5,990,802 | A * | 11/1999 | Maskeny | 340/815.45 |
| 6,064,318 | A | 5/2000 | Kirchner, III et al. | |
| 6,175,313 | B1 * | 1/2001 | Berezovsky | 340/929 |
| 6,317,058 | B1 | 11/2001 | Lemelson et al. | |
| 6,326,903 | B1 * | 12/2001 | Gross et al. | 340/988 |
| 6,331,824 | B1 * | 12/2001 | Firestone | 340/929 |

(Continued)

FOREIGN PATENT DOCUMENTS

| | | |
|---|---|---|
| BR | 9901803 | 1/2001 |

(Continued)

OTHER PUBLICATIONS

Sep. 8, 2006 PCT Notification Concerning Transmittal of International Preliminary Report on Patentability (Chapter I of the Patent Cooperation Treaty) in connection with PCT International Application No. PCT/US2004/006271.

(Continued)

*Primary Examiner*—George A Bugg
*Assistant Examiner*—Travis R Hunnings
(74) *Attorney, Agent, or Firm*—Dickstein, Shapiro, LLP.

(57) ABSTRACT

A vertical by standing LED paneled traffic light that is capable of communicating approximately how much time remains before the traffic light changes from a signal directing motorists to proceed to a signal directing motorists to stop. The traffic light having an LED panel for directing motor traffic, an LED panel for directing pedestrian traffic, an LED street sign and an LED panel for displaying an animated advertisement or important message, such as traffic conditions ahead.

16 Claims, 4 Drawing Sheets

U.S. PATENT DOCUMENTS

| | | | | |
|---|---|---|---|---|
| 6,552,668 | B1 * | 4/2003 | Berezovsky | 340/929 |
| 6,710,722 | B2 | 3/2004 | Lee | |
| 7,167,106 | B2 | 1/2007 | Haase | |
| 2002/0140604 | A1 | 10/2002 | Doi | |
| 2003/0060158 | A1 * | 3/2003 | Riganati et al. | 455/11.1 |
| 2005/0237224 | A1 | 10/2005 | Gotfried | |

FOREIGN PATENT DOCUMENTS

| | | | |
|---|---|---|---|
| CN | 2240171 | Y | 11/1996 |
| GB | 2296121 | A | 6/1996 |
| KR | 2001074148 | * | 8/2001 |
| KR | 2003037703 | | 5/2003 |
| WO | WO 2004/038685 | A1 | 5/2004 |
| WO | WO 2005/093684 | A1 | 10/2005 |
| WO | WO 2005/106823 | A1 | 11/2005 |

OTHER PUBLICATIONS

Jun. 28, 2007 Non-Final Office Action issued by the U.S. Patent and Trademark Office in connection with U.S. Appl. No. 11/212,312.

Jul. 17, 2007 PCT Notification of Transmittal of the International Search Report and the Written Opinion of the International Searching Authority, or the Declaration in connection with PCT International Application No. PCT/IB2006/003275.

Jun. 28, 2007 Non-Final Office Action issued by U.S. Patent and Trademark Office in connection with U.S. Appl. No. 11/212,312.

Apr. 4, 2008 First Office Action issued by the State Intellectual Property Office of the People's Republic of China in connection with related Chinese Patent Application No. 200480003158.9.

Fok, Alice, "Evolution in Art, NYC—Interview with Teddy Lo", *Not a Rag*, pp. 6-14 (Jun. 2004).

Morphology—Sep. 22-Oct. 19, 2003 Exhibition Poster, http://www.ledartist.com/morphposter_small.jpg. (May 19, 2005).

Written Opinion OfThe International Searching Authority issued Nov. 26, 2004 by the International Searching Authority in connection with related PCT International Application No. PCT/US04/6271, filed Feb. 27, 2004.

* cited by examiner

LED TRAFFIC LIGHT

FIELD OF THE INVENTION

The present invention relates to the field of traffic lights and, more particularly, to an LED traffic light.

BACKGROUND OF THE INVENTION

Traffic lights are ubiquitous from city streets to country roads. Traffic lights traditionally in the United States consist of three lights: green signifying traffic may pass, yellow signifying that traffic will soon come to a stop, and red signifying traffic must stop. These lights are generally vertically aligned, one on top of the other. In this way, traffic lights control traffic at an intersection. In other locations different conventions may be adopted, such as flashing yellow meaning traffic may pass.

Some conventional traffic lights are illuminated using incandescent light bulbs. Incandescent bulbs tend to use relatively large amounts of electricity and require periodic replacement as the bulbs burn out. These factors make the operation of incandescent traffic lights relatively expensive.

More recently, traffic lights are being illuminated using light emitting diodes (LEDs). LEDs provide a source of light that has relatively low energy consumption, and they do not bum out as easily as light-bulbs.

While conventional LED traffic lights are less expensive to operate, however, they maintain the conventional approach of three lights, vertically aligned, one on top of the other. While this approach has been used for a very long time, the use of a yellow light to signify that traffic will soon come to a stop has inherent problems. Specifically, motorists approaching a yellow traffic light do not know how much longer the traffic light will continue to stay yellow. These motorists may then unnecessarily speed up creating a safety risk for other motorists and pedestrians or come to a stop unnecessarily abruptly, thereby, creating a safety risk for other motorists.

Additionally, there is a need for quick dissemination of important information to motorists and pedestrians alike. This information may concern traffic conditions ahead or it may concern instructions disseminated in the event of an emergency. Because of the ubiquity of traffic lights, they are well suited for the conveyance of important information. Conventional traffic lights, however, fail to live up to fulfilling this objective.

Furthermore, the ubiquity of traffic lights make them well suited for the conveyance of advertisements that can be tailored to the particular community in which the traffic light is located. The use of advertisements on traffic lights can deliver an aesthetically pleasing futuristic look and be an important source of additional revenue for town and city governments that are increasingly under financial pressure. Conventional traffic lights fail to live up to fulfilling this objective as well.

SUMMARY OF THE INVENTION

An LED traffic light apparatus has a primary traffic panel, including a matrix of multicolored LEDs capable of controlling motor traffic by displaying various images, and a message panel including a matrix of multicolored LEDs capable of displaying information unrelated to the control of traffic.

An LED traffic light apparatus including a matrix of multicolored LEDs capable of controlling motor traffic by displaying various images, wherein the traffic light apparatus is capable of communicating approximately how much time remains before the traffic light changes from a signal directing motorists to proceed to a signal directing motorists to stop.

The present invention also contemplates an LED traffic light capable of being used as a communications station.

DETAILED DESCRIPTION OF PREFERRED EMBODIMENTS

The LED traffic light according to the present invention is an LED illuminated traffic light that is capable communicating to motorists approximately how much time remains before the traffic light changes from a signal directing motorists to proceed to a signal directing motorists to stop. Additionally, the LED traffic light according to the present disclosure is capable of disseminating important information such as traffic conditions and emergency instructions. Furthermore, the LED traffic light according to the present invention is also capable of displaying animated or still advertisements. The LED traffic light according to the present disclosure can be vertically or horizontally aligned.

Figure 1:
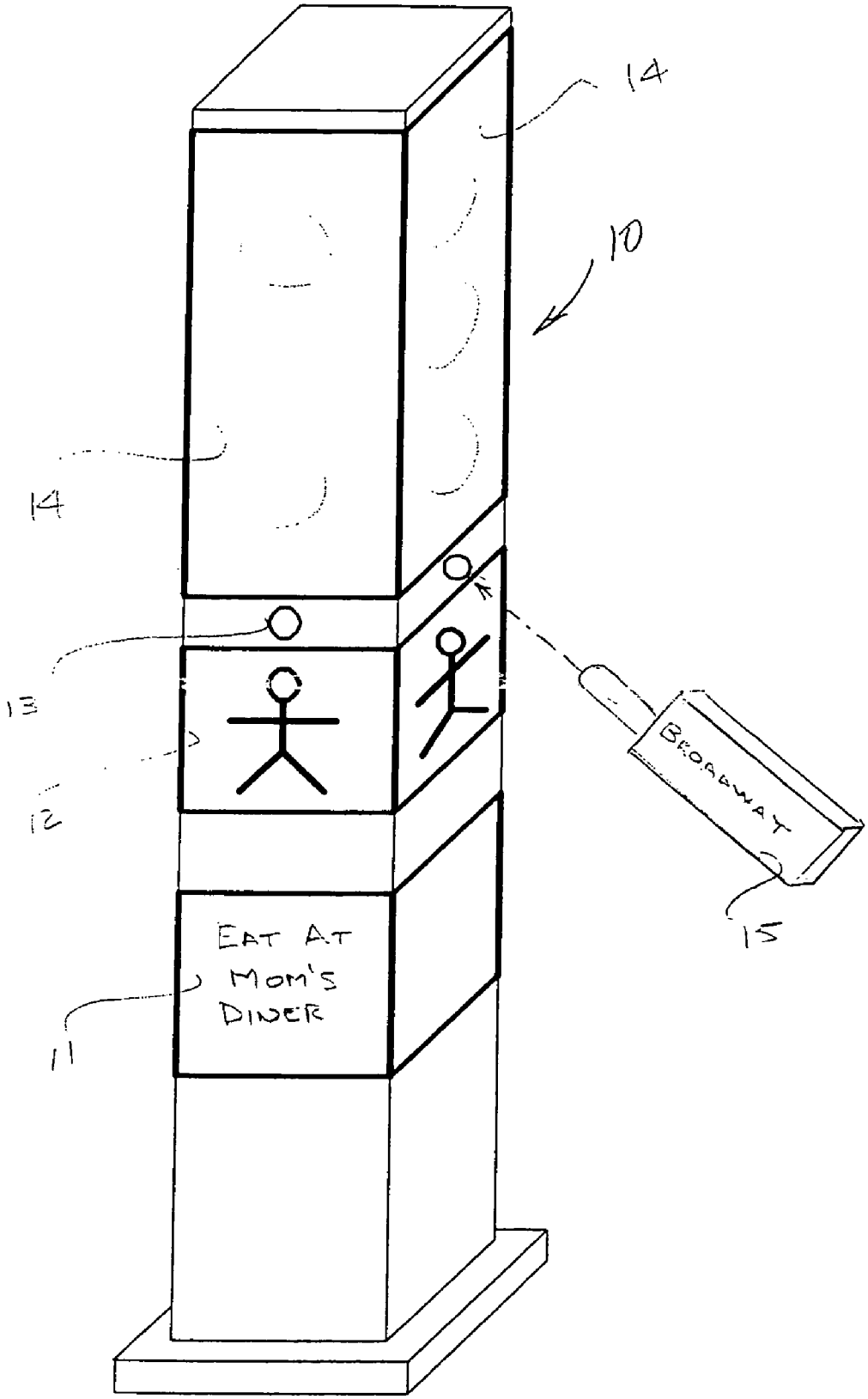
FIG. 1 shows an LED traffic light according to an embodiment of the present invention.

FIG. 1 illustrates a vertically aligned LED traffic light, in which the body 10 of the LED traffic light is a column or pillar, preferably a rectangular prism, and more preferably a rectangular prism with a square base and top and rectangular lateral sides. Preferably, the lateral sides are approximately 15 feet tall and the sides of the square top and bottom are approximately 15 inches wide. A base 16 can be attached to the bottom of the column 10 to increase the stability of the column. The base may be attached to the ground or floor, for example, by bolts, not shown. The base may also be attached to a foundation, for example, a cement foundation set below ground level.

The column 10 preferably has four lateral sides, but other configurations are possible such as a cylindrical prism having one continuous side or a triangular prism having three. The column must have one or more active surfaces. Active surfaces are lateral sides that contain LED panels. The column 10 has four active surfaces allowing the LED traffic light to control traffic in four directions at a four-way intersection.

According to one preferred embodiment of the present invention, mounted to each active surface of the column 10 is one primary LED traffic panel 14, one street sign receiving aperture 13, one pedestrian LED traffic panel 12, and one message LED panel 11. The invention is not limited to having one of each element, and various combinations are possible depending on the needs of the environment where the column 10 is installed.

The primary LED traffic panel 14 is preferably a low-resolution multicolored LED panel. This panel may also be formed from multiple smaller low-resolution multi-colored LED panels assembled together. For example, the primary LED traffic panel 14 can be constructed from combining 18 (9 rows of 2) light emitting diode dot matrix modules known as the 833Intelligent Module (IM) manufactured by Desay Optotech Ltd. of Huizhou, China. The primary LED traffic panel 14 is responsible for controlling motor traffic and functions as a replacement for the conventional traffic light. The primary LED traffic panel 14 directs traffic by displaying an image on the panel's surface. The specific images that are displayed depend on the primary traffic panel display scheme used. Examples of primary traffic panel display schemes are described in detail below.

The street sign receiving aperture 13 allows for the attachment of a street sign 15. When a street sign 15 is attached, the LED traffic light also functions as a street sign. The street sign 15 may be a conventional pre-printed sign board or the street sign 15 may be an LED panel capable of displaying any programmed street name or other information like cross streets or building numbers. Even in embodiments of the present invention where the column 10 has four active surfaces, two street signs orthogonally oriented may be sufficient to convey street names.

The pedestrian LED traffic panel 12 is preferably a low-resolution LED panel, formed as a multicolored LED panel. This panel may also be formed from multiple smaller low-resolution multicolored LED panels combined in a single unit. For example, the pedestrian LED traffic panel 14 can be constructed by combining 6 (3 rows of 2) light emitting diode dot matrix modules known as the 08331M manufactured by Desay Optotech Ltd. of Huizhou, China. The pedestrian LED traffic panel 12 is responsible for directing pedestrian traffic and functions as a replacement for the conventional "walk/don't walk" pedestrian traffic signal. The pedestrian LED traffic panel 12 directs pedestrian traffic by displaying an image on the panel's surface. The specific images that are displayed depend on the pedestrian traffic panel display scheme used. Examples of pedestrian traffic panel display schemes are described-in detail below.

The message LED panel 11 is preferably a high-resolution LED panel, such as a multicolored LED panel. This panel may also be formed from multiple smaller high-resolution multicolored LED panels combined as a single unit. For example, the message LED traffic panel 11 can be constructed from combining 12 (6 rows of 2) light emitting diode dot matrix modules known as the 0630IM manufactured by Desay Optotech Ltd. Of Huizhou, China. The message LED panel 11 is capable of displaying important information such as traffic conditions and emergency instructions. Additionally, the message LED panel 11 is capable of displaying full color high-resolution advertisements that may be animated or still.

Furthermore, the message panel 11, the pedestrian traffic panel 12, and the primary traffic panel 14 can all have the same resolution, as provided by the LED modules. Also, the locations on the body 10 of the message panel 11, the pedestrian traffic panel 12, and the primary traffic panel 14 are interchangeable. This can be done physically or by software. Alternatively, all three panels can be used as message boards.

Figure 2:
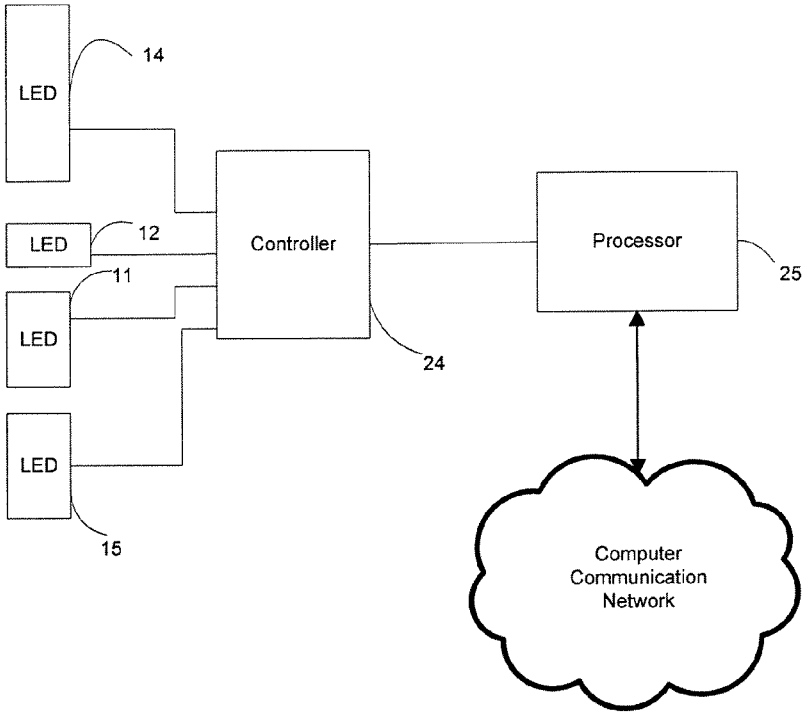
FIG. 2 is a block diagram of an the LED control apparatus according to an embodiment of the present invention.

As shown in FIG. 2, the primary LED traffic panel 14, the pedestrian LED traffic panel 12 and the message LED panel 11 are all controlled by an LED panel controller 24. Additionally, when the street sign 15 contains an LED panel or other lighted element, the street sign 15 is also controlled by the panel controller 24. The panel controller 24 controls each LED on the LED panels according to instructions provided by a signal processor 25. The signal processor 25 may be a computer with a microprocessor, memory, storage device, such as a hard disk, and an interface for sending instructions to the panel controller 24. The signal processor 25 may also include other hardware necessary for controlling the LED panels 11, 12, 14, 15 and the controller 24. The signal processor may be located within of the column 10 or at a remote location.

The signal processor 25 runs a program for controlling the primary LED traffic panel 14 according to the primary LED traffic panel scheme, controlling the pedestrian LED traffic panel 12 according to the pedestrian LED traffic panel scheme and controlling the message LED panel 11 according to a message program as described below.

The signal processor 25 controls the primary LED traffic panel 14 according to the primary LED traffic panel scheme (primary scheme). This primary scheme defines what images the primary LED traffic panel 14 displays to direct traffic and the logic used to determine when to display the various defined images.

Figure 3A:
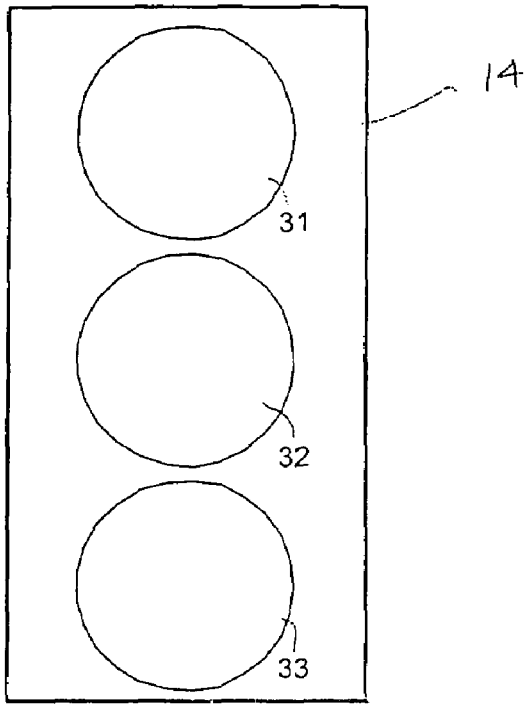
FIGS. 3A, 3B and 3C show primary LED traffic panel schemes according to an embodiment of the present invention.
Figure 3B:
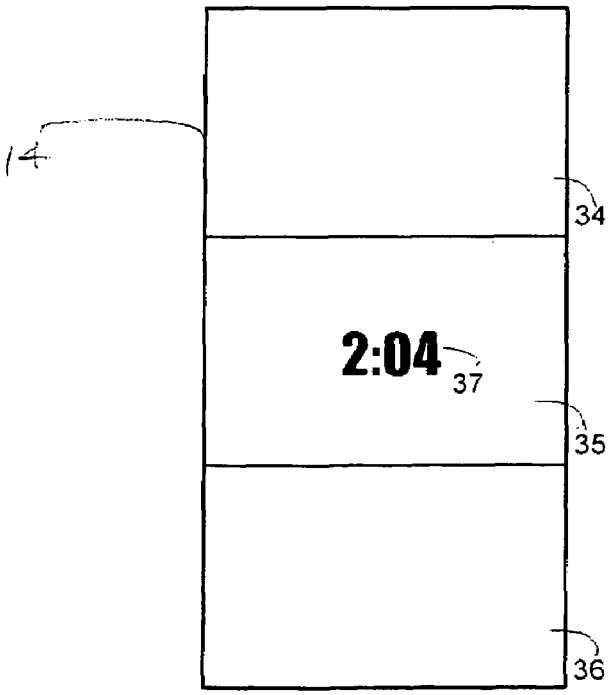
Figure 3C:
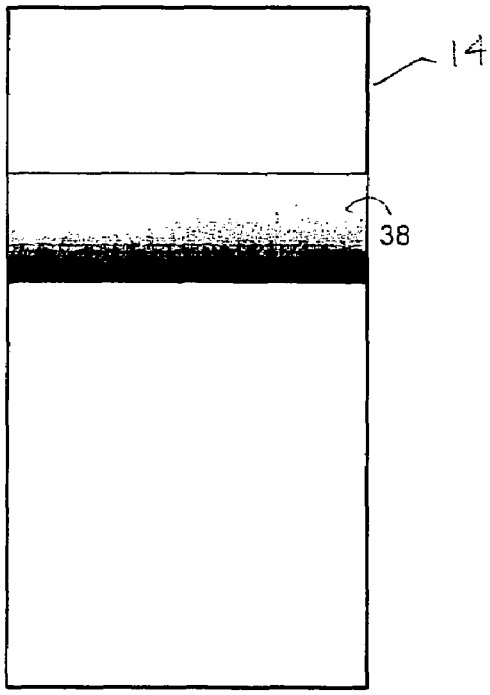

FIGS. 3A-3C illustrate several examples of primary schemes that can be used according to the current specification. The most basic primary scheme is illustrated in FIG. 3A, this is the conventional primary scheme for a traffic control light. According to this scheme, three circles are depicted representing the circles of a conventional traffic light. As with a conventional traffic light, when traffic is to be directed to proceed, the top circle 31 glows green. When traffic is to be informed of an impending red light, the center circle 32 glows yellow. When traffic is to be directed to stop, the bottom circle 33 glows red. Additionally, other traffic signals can be created, such as blinking yellow and blinking red signals, as desired. The conventional scheme includes the images to be displayed and the logic for directing traffic according to this scheme.

FIG. 3B illustrates an example of a modified conventional primary scheme. This scheme may be any scheme that preserves basic characteristics of the conventional scheme. For example, the conventional scheme may be modified to consist of three rectangles, as shown in FIG. 3B. These rectangles would act in the same way the three circles of the conventional primary scheme as illustrated in FIG. 3A and described above. For example, when traffic is to be directed to proceed, the top rectangle 34 glows green. When traffic is to be informed of an impending red light, the center rectangle 35 glows yellow. When traffic is to be directed to stop, the bottom rectangle 36 glows red.

Other modifications could include causing the entire primary LED panel to turn one solid color such as all red, all yellow, or all green to control traffic. Other modifications could incorporate the use of a count-down timer indicating how much longer the signal will remain the same until it is time to switch. For example, when the light is yellow, a timer in the form of black digital display 37 located in the center of the yellow light 35 can count down the time remaining until the light turns red. Another example would be the use of a stripe (not shown) either vertically or horizontally aligned that shrinks as the time until the next light change approaches. After the stripe has fully disappeared, the light changes. These count-down timers would give motorists greater opportunity to ascertain whether they should come to an immediate stop or continue through the intersection, thereby aiding the flow of traffic and increasing the safety of the intersection.

FIG. 3C illustrates an example of a gradient primary scheme. The gradient primary scheme calls for the illumination of only a horizontal strip 38. The strip begins at the top of the LED panel where the gradient is colored green. The strip then moves downward illuminating a color that is increasingly yellow and decreasingly green until the strip is half-way down the LED panel and fully yellow. At this point the strip continues to move downward illuminating a color that is increasingly red and decreasingly yellow. When the strip has reached the bottom of the LED panel, it is fully red. Then a clear signal is sent indicating that traffic is directed to stop. For example, the strip may disappear and the entire rectangle will turn red. The use of this timed gradient allows motorists greater opportunity to ascertain whether they should come to an immediate stop or continue through the intersection, thereby aiding the flow of traffic and increasing, the safety of the intersection.

The pedestrian LED traffic panel 12 is controlled according to the pedestrian LED traffic panel scheme (pedestrian scheme). This pedestrian scheme defines what images the pedestrian LED traffic panel 12 displays to direct traffic and the logic used to determine when to display the various defined images. The conventional pedestrian scheme illustrates a white stick figure of a person walking indicating that pedestrian traffic may cross the street. A red stick figure of a person standing still indicates that pedestrian traffic may not cross the street. The animated pedestrian scheme uses figures similar to the conventional pedestrian scheme, however, the stick figures are animated to greater clarify the intent of the signal. For example, when pedestrian traffic is directed to proceed with crossing the street, a white stick figure person may have legs that move to indicate walking. Animation need not be limited to the walking signal, for example, when pedestrian traffic is directed to refrain from crossing the street, a red stick figure person might be shown to repeatedly tap one foot to illustrate waiting. Additionally, the timer features discussed above may be incorporated into the pedestrian scheme. For example, a count-down timer might accompany the walking stick figure.

A message program is used to control the message LED panel 11 according to the present invention. The message program runs on the signal processor 25, and the signal processor 25 is connected to a computer communications network such as the internet or a wide area network, as shown in FIG. 2. The signal processor 25 may be connected to the network via a standard telephone line, a DSL line, a fiber-optic line, a coaxial cable or any other form of wired connection. Alternatively, the processor 25 may be connected to the network via a wireless connection, such as a wireless connection over a digital cellular telephone network or a wireless local area network connection, such as a wireless connection conforming to IEEE 802.1B. The network connection may be over the internet using a secure method of communication such as encryption and/or a secure virtual private network (VPN). Using the network connection, the municipality or contracted administrator may modify the message program to update messages or to install animated advertisements. The message program determines what messages are displayed on the message LED panel 11. The message LED 11 panel is also capable of disseminating important information such as traffic conditions and emergency instructions. For example, text can be displayed indicating that poor traffic conditions are ahead and advising motorists of alternative routes or information to motorists to be on the lookout for a particular vehicle suspected of transporting a fugitive. Text can be displayed all at once or text may scroll across the panel. The message program is capable of receiving any manner of message from the network.

In order to increase municipal revenue, municipalities may choose to run advertisements on the message LED panel 11. Because the message panel is high resolution, television style advertisements can be displayed. These advertisements can be tailored for the particular community in which the traffic light is installed, thereby increasing the value of the advertisement. The advertisements can be regularly updated over the network connection.

The traffic light according to the present invention can be useful in an additional number of ways. For example, because of its network connection, the traffic light can be used as an emergency call box for fire fighters and police. The traffic light can be used as a cellular phone transmitter or relay station or as a wireless internet transmitter station or hotspot. The traffic light can be adapted to include audio and/or video surveillance equipment to assist in law enforcement, emergency response or advertising.

Additionally, an emergency motif can be used to wan motorists and pedestrians to move to the curb or stay on the sidewalk in the event of an oncoming emergency vehicle.

The traffic light according to the present invention has the added advantage of being easily configurable to display a holiday or festive motif. To implement such a motif, the utilized schemes can be modified to display timely festive accents on one or more LED panels. The use of specialized motifs is not limited to holidays and festivals, motifs can be used to modify the appearance of traffic lights in accordance with the cultural or historic significance of the neighborhood or area in which the traffic light is located.

Figure 4:
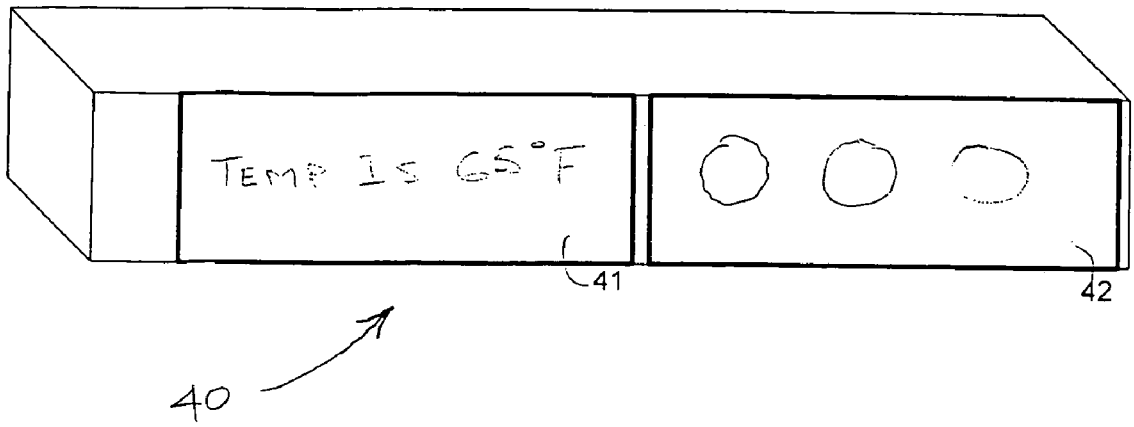
FIG. 4 shows another embodiment of LED traffic light according to the present invention.

The traffic light according to the present invention is not limited to a vertical column configuration, and the traffic light may be horizontally oriented. FIG. 4 illustrates an embodiment of the present invention where the traffic light is horizontally oriented. According to one example of a horizontal orientation, the traffic light 40 is held over the intersection by cables or attached to one or more support columns. The primary LED traffic panel 42 directs traffic while the message LED panel 41 displays a message or advertisement. A pedestrian LED traffic panel (not shown) and/or a street sign (not shown) may also be included in horizontal embodiments.

It is to be understood that the foregoing is by way of example only and that many alternatives and changes can be made by one skilled in the art, so that the scope of the invention is defined only by the appended claims.

The invention claimed is:

1. A unitary traffic light apparatus comprising:

a primary traffic panel including a first matrix of multicolored LEDs, said primary traffic panel directing motor traffic; and a message panel coupled directly to said primary traffic panel, said message panel including a second matrix of multicolored LEDs, said message panel displaying information unrelated to the directing of traffic, wherein said unitary traffic light apparatus is a column with at least three lateral sides, and wherein a plurality of said lateral sides comprise said primary traffic panel and said message panel.

2. The unitary traffic light apparatus of claim 1, wherein said primary traffic panel directs motor traffic by displaying images that communicate information relating to how much time remains before said primary traffic panel changes from a signal directing motorists to proceed to a signal directing motorists to stop.

3. The unitary traffic light apparatus of claim 1, further comprising means for causing said message panel to display messages provided over a computer communications network.

4. The unitary traffic light apparatus of claim 1, further comprising means for modifying a display scheme according to a special motif.

5. The unitary traffic light apparatus of claim 1, wherein said message panel includes means for displaying animated advertisements.

6. The unitary traffic light apparatus of claim 5, wherein said animated advertisements are provided over a computer communications network.

7. A unitary traffic light apparatus comprising a first matrix of multicolored LEDs, said first matrix directing motor traffic and providing a visual indicator of how much time remains before a traffic light signal displayed on said first matrix changes from a signal directing motorists to proceed to a signal directing motorists to stop; and a second matrix of multicolored LEDs coupled directly to said first matrix, said second matrix displaying information unrelated to the directing of traffic, wherein said unitary traffic light apparatus is a column with at least three lateral sides, and wherein a plurality of said lateral sides comprise said first matrix and said second matrix.

8. The unitary traffic light apparatus of claim 7, wherein said visual indicator is a count-down timer.

9. The unitary traffic light apparatus of claim 7, wherein said visual indicator is a shrinking stripe.

10. The unitary traffic light apparatus of claim 7, wherein said visual indicator is a gradient horizontal strip.

11. A unitary traffic light apparatus comprising:

a primary traffic panel including a first matrix of multicolored LEDs, said primary traffic panel directing motor traffic;

a message panel including a second matrix of multicolored LEDs, said message panel displaying information unrelated to the directing of traffic; and a pedestrian traffic panel including a third matrix of multicolored LEDs, said pedestrian traffic panel directing pedestrian traffic, wherein said pedestrian traffic panel, said primary traffic panel, and said message panel are directly coupled, wherein said unitary traffic light apparatus is a column with at least three lateral sides, and wherein a plurality of said lateral sides comprise said primary traffic panel and said message panel.

12. The unitary traffic light of claim 1, 7, or 11, wherein said column is rectangular or triangular.

13. A unitary traffic light apparatus comprising:

a primary traffic panel including a first matrix of multicolored LEDs, said primary traffic panel directing motor traffic;

a message panel which includes a second matrix of multicolored LEDs, said message panel displaying information unrelated to the directing of traffic; and a spacer directly coupled between said primary traffic panel and said message panel, wherein the unitary traffic light apparatus is a rectangular column with four lateral sides, and wherein a plurality of said lateral sides comprise said primary traffic panel, said spacer, and said message panel.

14. A unitary traffic light apparatus comprising:

a primary traffic panel including a first matrix of multicolored LEDs, said primary traffic panel directing motor traffic;

a pedestrian traffic panel including a second matrix of multicolored LEDs, said pedestrian traffic panel directing pedestrian traffic;

a message panel including a third matrix of multicolored LEDs, said message panel displaying information unrelated to the directing of traffic;

a first spacer directly coupled between said primary traffic panel and said pedestrian traffic panel; and a second spacer directly coupled between said pedestrian traffic panel and said message panel, wherein said unitary traffic light apparatus is a rectangular column with four lateral sides, and wherein a plurality of said lateral sides comprise said primary traffic panel, said first spacer, said pedestrian traffic panel, said second spacer, and said message panel.

15. The unitary traffic light apparatus of claim 14, further comprising at least one street sign coupled to said first spacer.

16. The unitary traffic light apparatus of claim 15, wherein said at least one street sign comprises an LED panel.

* * * * *